US005631598A

United States Patent [19]

Miranda et al.

[11] Patent Number: 5,631,598

[45] Date of Patent: May 20, 1997

[54] FREQUENCY COMPENSATION FOR A LOW DROP-OUT REGULATOR

[75] Inventors: Evaldo M. Miranda, San Jose, Calif.; Todd Brooks, Boston; A. Paul Brokaw, Burlington, both of Mass.

[73] Assignee: Analog Devices, Inc., Norwood, Mass.

[21] Appl. No.: 488,403

[22] Filed: Jun. 7, 1995

[51] Int. Cl.[6] ..... G05F 1/10; G05F 3/02

[52] U.S. Cl. ..... 327/540; 327/563; 327/483; 327/67; 330/254

[58] Field of Search ..... 327/538, 540, 327/541, 543, 546, 560, 561, 562, 563, 575, 483, 179, 232, 67, 72, 73; 330/254, 260, 271, 277, 278

[56] References Cited

U.S. PATENT DOCUMENTS

| | | | |
|---|---|---|---|
| 4,356,409 | 10/1982 | Masuda et al. | 327/540 |
| 4,618,832 | 10/1986 | Schenck | 330/254 |
| 4,779,037 | 10/1988 | LoCascio | 323/275 |
| 4,825,176 | 4/1989 | Velo | 330/254 |
| 4,908,566 | 3/1990 | Tesch | 323/280 |
| 5,105,102 | 4/1992 | Shioda | 327/541 |
| 5,132,555 | 7/1992 | Takahashi | 327/540 |
| 5,140,191 | 8/1992 | Nogle et al. | 327/541 |
| 5,168,209 | 12/1992 | Thiel | 327/540 |
| 5,191,278 | 3/1993 | Carpenter | 323/275 |
| 5,365,161 | 11/1994 | Inoue et al. | 323/282 |
| 5,373,226 | 12/1994 | Kimura | 327/541 |
| 5,463,345 | 10/1995 | Nagahori et al. | 327/483 |
| 5,519,656 | 5/1996 | Maccarrone et al. | 327/540 |

FOREIGN PATENT DOCUMENTS 0531945 3/1993 European Pat. Off. .

OTHER PUBLICATIONS

Solomon, "The Monolithic Op Amp: A Tutorial Study," IEEE (1974) pp. 12–30.

Reay and Kovacs, "An Unconditionally Stable Two–Stage CMOS Amplifier," IEEE (1995), vol. 30, No. 5, pp. 591–594.

Texas Instruments, "Advanced LinCMOS Rail–To–Rail Dual Operational Amplifiers," (schematic 1992).

*Primary Examiner*—Timothy P. Callahan
*Assistant Examiner*—My-Trang Nu Ton
*Attorney, Agent, or Firm*—Hale and Dorr

[57] ABSTRACT

A low drop-out voltage regulator is compensated by providing a compensation capacitor across an output terminal of the regulator and an output lead of an input stage which compares a reference voltage and a voltage derived from a regulated output signal at the output terminal. The output from the input stage is inverted without gain before being provided to an output stage. This inversion allows Miller compensation with the compensation capacitor.

25 Claims, 2 Drawing Sheets

FREQUENCY COMPENSATION FOR A LOW DROP-OUT REGULATOR

FIELD OF THE INVENTIONS

This invention relates to frequency compensation in circuits, and particularly in regulator circuits.

BACKGROUND OF THE INVENTION

It is known to provide frequency compensation circuits. An example of this is found in Solomon, "The Monolithic Op Amp: A Tutorial Study," IEEE J. Solid-State Circuits, December 1974. In the Solomon article, a capacitor is included in the circuit between stages of an op-amp for performing frequency compensation. This capacitor "splits" poles of the circuit so that one pole is dominated by the compensation capacitor and the other pole is dominated by a load capacitor. By splitting the poles, the higher frequency pole has greater than a unity gain frequency. This pole splitting technique maintains circuit stability by preventing the phase shift becoming greater than 180° at frequencies less than the unity gain frequency.

Low drop-out regulators, i.e., regulators with a small difference between the input voltage and the regulated output voltage, and other circuits that drive a load to a voltage near one or both supply rails, can be difficult to compensate. Such circuits often have a large load capacitor in parallel to a load resistor. If the load capacitor is known and dependable, it can be used for part or all of the frequency compensation for the circuit. Generally, however, this capacitor is not dependable because it was not particularly selected to match the particular components of the low drop-out regulator at issue.

A frequent problem when large capacitors are included in a circuit particularly is the effect of the equivalent series resistance (ESR). For example, electrolytic capacitors can have an ESR ranging from many hundredths to several ohms. Even more difficult to deal with is that the ESR can increase over time. While the ESR may not interfere with filtering, it does introduce into the frequency response a zero that can stop the roll-off of the gain and can extend the bandwidth to higher frequencies at which other poles can affect the frequency response. Another consideration is that gain and loop stability are further complicated by the wide variability of resistive loads.

The problems generated by the variation in possible resistive and capacitive loads are most acute in a regulator with a high output impedance element, such as a collector or drain. Load capacitance may be addressed by indicating to users and potential users, through a product specification, that a minimum capacitance between the output terminal and ground that is required, and that this capacitor must have an ESR in a particular range. This approach, however, relies on users for proper selection of the load capacitor.

In one known regulator circuit, an operational transconductance amplifier ("OTA") receives a feedback voltage derived from a regulator output voltage at its inverting input via a voltage divider. A reference voltage connects to its non-inverting input. The OTA compares these voltages and provides an output current to a load to equalize the feedback and reference voltages. A load can include a load resistor, a load capacitor $C_L$ with its inherent ESR, and even an additional current source which appears as a high impedance load.

To regulate the load voltage, the transconductance ($g_m$) of the OTA is large so that the OTA will provide the necessary load current if there is a small voltage difference at the inputs. Because an OTA will have internal poles, the unity gain frequency should be located well below the frequencies of these poles. This limitation requires any load capacitor $C_L$ to be relatively large. This is usually not a problem because there typically is a desire to make $C_L$ large enough to filter effectively against the lead resistance. This remains true as long as the ESR of the load capacitor is small enough.

Load capacitor $C_L$ causes a pole at very low frequency and the gain decreases until the reactance of $C_L$ equals the ESR. At this point, there is a zero of response, and the gain stops decreasing with increased frequency. If the ESR is greater than the reciprocal of the product of $g_m$ and an attenuation factor from the voltage divider, this zero response occurs at a frequency below the desired crossover frequency. At higher frequencies, therefore, nuisance poles of the OTA can destabilize the feedback loop.

Another approach to control regulation of the load voltage is to cascade two OTAs and provide a compensation capacitor that connects to the line between an output of the first OTA and an input to the second OTA. When the circuit is lightly loaded, it will have a large, finite voltage gain that is a product of the limiting gains of the OTA's. Neglecting the compensation capacitance, the gain begins to roll off at a frequency determined by load capacitor $C_L$ and by a total load resistance seen by the second OTA, including load resistance $R_L$ and any internal impedance. This result is complicated, by additional poles, the most prominent of which is at the output of the first OTA. This is due to an unavoidable capacitance at the output of the first OTA and an input capacitance of the second OTA. If the two OTAs are similar, the frequencies of the two poles are near each other, thus causing the circuit to have a 40 dB/decade roll-off and marginal stability.

A compensation capacitor $C_c$ may be placed between the output of the first OTA and the output of the circuit to address the uncertainty about load capacitor $C_L$ and its inherent ESR. In the absence of a load capacitor $C_L$, compensation capacitor $C_c$ may be chosen to give a unity gain frequency lower than a frequency at which other poles affect the response. If load capacitor $C_L$ is large, however, it dominates the response and can roll off the gain before some other pole appears.

Cascaded OTA's each have poles and each requires a stable loop when used in a local feedback loop. This issue becomes a very serious problem in a low drop-out regulator in which an input section and an output device are connected to different supply rails. These regulators have problems that are not easily solved as described for the circuit referred to above.

In one type of positive low drop-out regulator in which an input stage is referred to one supply rail, such as ground, and an output stage is referred to another supply rail, the output stage may include a P-type transistor, such as a PNP or PFET, connected between a supply rail and the load. The P-type transistor causes the regulator to pull the load positive in response to a drive pulling negative on its control electrode. The control signal to the control electrode may be provided by an N-type transistor that receives a control signal from an output of an OTA. This output signal is based on a difference between a reference voltage at a non-inverting input lead and a voltage based on the output signal at an inverting input.

SUMMARY OF THE INVENTION

The present invention is a regulation circuit that is fully frequency compensated. According to the present invention, a voltage regulator has an input stage for comparing a reference voltage and an input voltage derived from the output voltage. This input stage also amplifies the difference in the voltages to provide an amplified error signal. The input stage is coupled to an inverter for inverting the amplified error signal. An output stage of the voltage regulator is coupled to the inverter for providing a regulating signal at output in response to the inverted signal. A compensation capacitor is coupled between the output of the circuit and the output of the input stage. Preferably, the voltage regulator circuit has an output signal that approaches one or both of the supply rails, and has a load with a load capacitor. The compensation capacitor is placed to effectively split the poles so that the gain reaches the unity gain frequency before any other poles in the system cause a phase shift of more than 180°.

In a preferred embodiment, the input stage includes a differential transistor pair having an output at a drain or collector of one of the transistors. The inverter is a unity. gain amplifier having a feedback loop that contains a feedback resistor and an equal input resistor. The input resistor is coupled to the collector or drain of a transistor of the differential pair.

The output stage preferably includes an N-type transistor with its base or gate connected to the inverted signal and a collector or drain coupled to the base or gate of a P-type transistor. The P-type transistor has an emitter or source coupled to a supply rail. The load includes a load resistor in parallel with a load capacitor. The load may include a high impedance current source in parallel with the load resistor and load capacitor.

The inverter between the input stage and the output stage allows the compensation capacitor to be coupled across an output terminal and an output from the comparing stage. Additional features, such as a cascade connection, may be added. The regulator according to the present invention is made stable without relying on a user to provide a proper capacitance with a proper ESR.

Other features and advantages will become apparent from the following detailed description when read in conjunction with the drawings, and from the claims.

DETAILED DESCRIPTION

The present invention is a regulator circuit that is fully frequency compensated. The present invention is useful in the voltage regulators, and particularly in a low drop-out voltage regulator with a high impedance output stage and when regulator stages are connected stages to different supply rails. A low drop-out voltage regulator circuit of the present invention is frequency compensated to maintain stability without relying on the precise selection of a load capacitor. To achieve this compensation, an output signal of an input stage is inverted, and a compensation capacitor is provided across an output of the input stage and an output of the regulator. The regulator of the present invention will now be described in detail.

Figure 1:
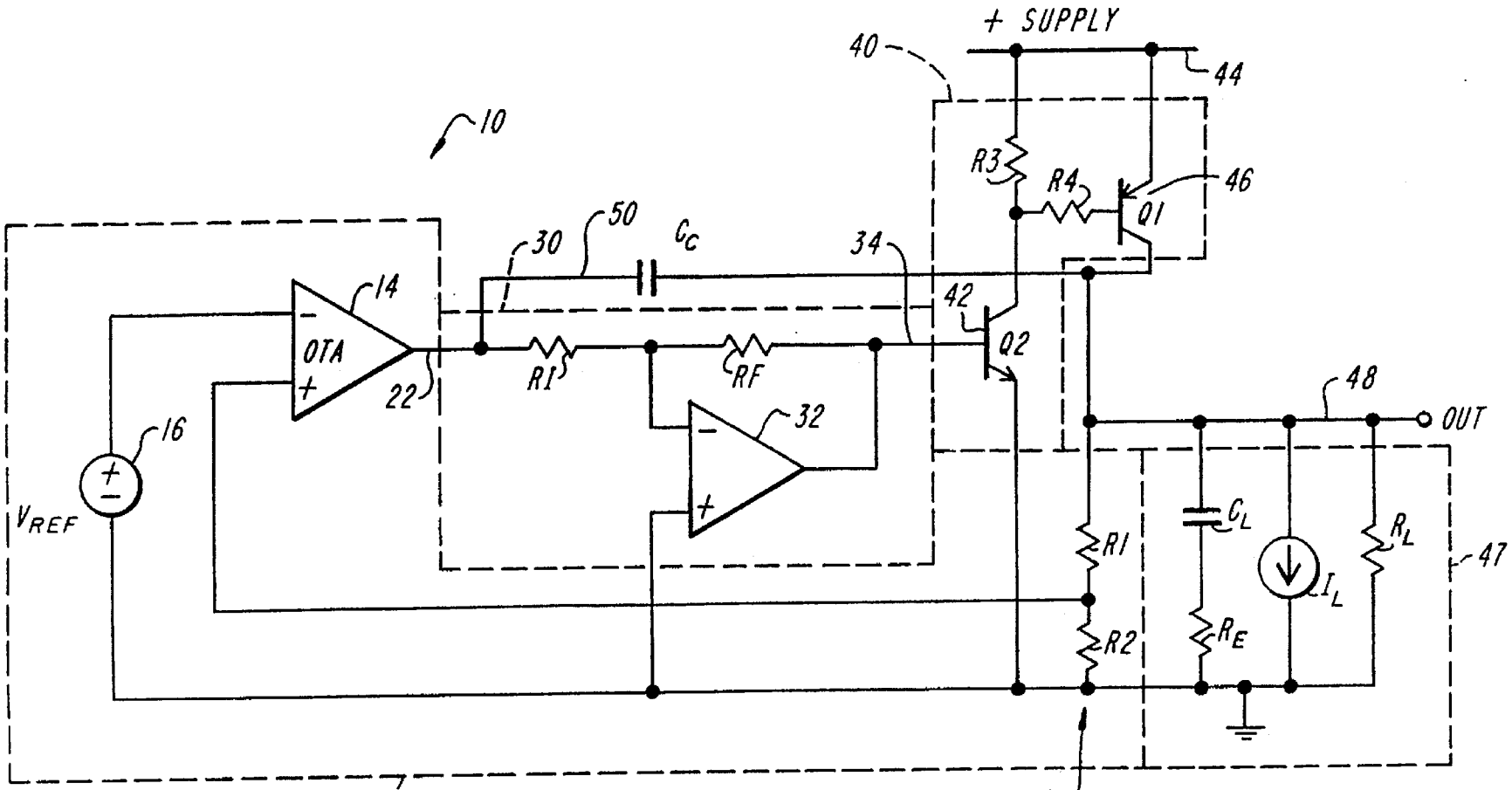
FIG. 1 is a schematic of a voltage regulator according to the present invention.

Referring to FIG. 1, low-drop-out regulator 10 has differential input stage 12, inverting stage 30, and output stage 40. The purpose of a regulator 10 is to receive an input voltage and to provide to a load a regulated output signal at output terminal OUT. The connection and operation of these elements will be described along with the method of providing frequency compensation.

Regulator 10 has differential input stage 12 which has error sensing operational transconductance amplifier (OTA) 14. A reference voltage is input to the inverting input of OTA 14 and a voltage 16 signal derived from output stage 40 is input to the non-inverting input of OTA 14. The input voltage signal at the non-inverting input to OTA, more specifically, is derived from the output signal at output of the regulator through voltage divider 18 consisting of resistors R1 and R2. The voltage at non-inverting input is determined by the expression:

$$V+=VOUT(R2/(R1+R2))$$

The difference between the voltages input to OTA 14 results in an error signal being provided on line 22, the output of input stage 12.

Inverting stage 30 is for receiving and inverting the error signal. Inverting stage 30 preferably includes operational amplifier (OPAMP) 32, input resistor RI, and feedback resistor RF. The non-inverting input of OPAMP 32 connects to ground and the inverting input connects to the error signal at the node between RI and RF. Because inverting stage 30 introduces its frequency response into the loop, inverting stage 30 preferably has a very wide bandwidth so that its poles are much higher than the unity gain frequency. The bandwidth is also higher than a parasite pole formed in the loop of the second stage, mainly by the load capacitor $C_L$ in parallel with 1/gm. Consequently, OPAMP 32 preferably has unity gain, so RI=RF. If desired, inverting stage 30 can provide some gain. The inverted error signal is provided on line 34 at the output of inverting stage 30.

Output stage 40 receives the inverted error signal as a control signal, and provides a regulating output signal. In a bipolar embodiment shown in FIG. 1, output stage 40 preferably includes an NPN transistor Q2 at 42 with its base coupled to the output inverting stage 30. The collector of transistor 42 is coupled through resistor R3 to supply rail 44, and through resistor R4 to a control lead of a PNP transistor Q1 at 46. The emitter of transistor 42 is connected to ground.

The emitter of PNP transistor 46 is connected to supply rail 44. The collector of PNP transistor 46 is coupled to output 48 of regulator 10. The load 47 includes, in parallel, a load resistor $R_L$, a load capacitor $C_L$ with it inherent ESP which is represented by $R_E$, and, current sink $I_L$.

Figure 2:
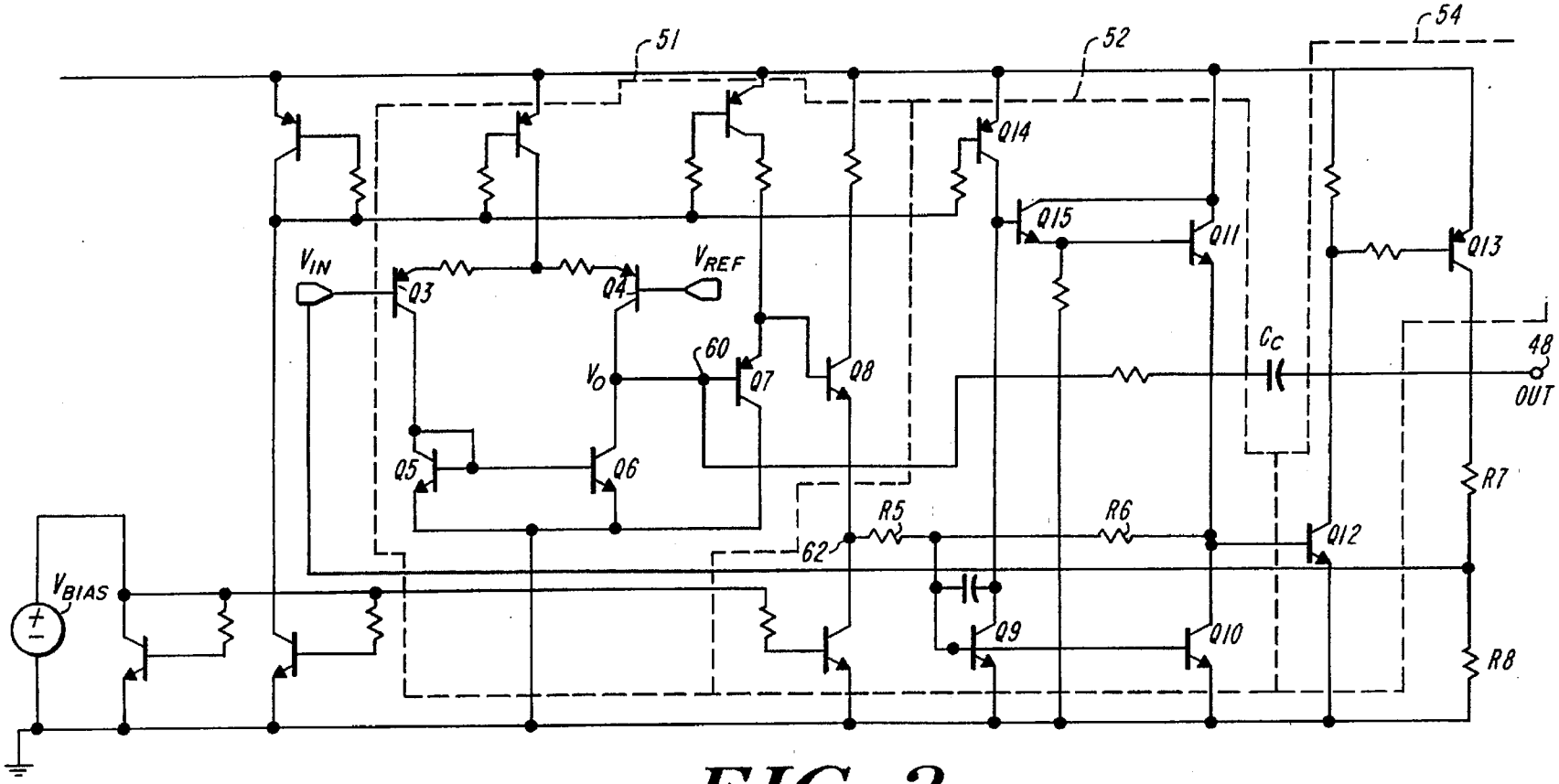
FIG. 2 is a more detailed schematic of a voltage regulator of the type shown in FIG. 1

Compensator capacitor Cc is in line 50 that connects the output of OTA 14 and the line that connects to output 48 of the regulator (as shown in the more detailed FIG. 2, the compensator capacitor preferably is actually coupled in the OTA between a differential pair and a buffer). The purpose of capacitor $C_c$ is to splits the poles, so that the first pole associated with OTA 14 is dominated by capacitor$_c$, and the second pole dominated by load capacitor $C_L$. At lower frequencies, load capacitor $C_L$ causes the gain to begin to roll off. With increased frequency, compensator capacitor $C_c$ increasingly closely couples output 48 and the output of OTA 14 in line 22. The compensation capacitor suppresses poles from parasitic capacitances and allows the gain to cross unity at a frequency below the destabilizing poles from these parasitic capacitances.

In this circuit shown in FIG. 1, the voltage at the output of OTA 14 on line 22 is $G(V_+-V_{ref})$, where G is the open loop gain of OTA 14. Since RI=RF, the gain of OPAMP 32 is −1, and thus the inverted error signal on line 34 is $G(V_{ref}-V_+)$. If $V_+$ is less than $V_{ref}$ by a sufficient amount, the inverted output is positive and causes transistor Q2 to turn on. This activation of transistor Q2 draws the base of PNP transistor Q1 toward ground, thus causing transistor Q1 to turn on and pull the lead more positive thus regulating output 48.

FIG. 2 is a more detailed schematic of the circuit shown in FIG. 1. In FIG. 2, a reference voltage is applied to input $V_{ref}$ and an error feedback to input $V_{in}$ of differential input stage 51. Input stage 51 includes transistors Q3–Q8. The differential output signal $V_O$ produced by differential stage transistors Q3–Q6 is buffered by transistors Q7 and Q8, which provide the buffered input stage output signal at node 62, the emitter of transistor Q8 (the output of the input stage can refer to the signal either at node 60 or at node 62).

An inverter stage 52, which includes resisters R5=R6 and transistors Q9–Q11 and Q14–Q15, receives, inverts, and buffers the buffered input stage output signal. Transistor Q9 and resisters R5 and R6 invert the input signal and provide the inverted signal to a buffer including a Darlington follower transistor pair Q15, Q11. The buffered inverted signal is provided to the base of transistor Q12.

Transistor Q10 is a load-sensitive current source that biases transistor Q11. Because the bases of transistors Q9 and Q10 are coupled together, as the signal to the base of transistor Q9 changes, it causes a corresponding change at the base of transistor Q10. Thus, transistor Q10 provides changes in current as needed to R6, and therefore transistor Q11 need not fluctuate to provide current to resistor R6. Consequently, transistor Q11 serves as a more ideal buffer than it would if transistor Q10 were a constant current source. In that case, an increase at the base of transistor Q9 would cause transistor Q11 to provide more current to resistor R6. Accordingly, transistor Q11 would have to be a large current source to accommodate possible fluctuations.

Transistor Q12 is an NPN transistor that is controlled by the inverted signal to provide, at its collector, a control signal for PNP transistor Q13. Transistor Q13 pulls the output of the regulator more positive when $V_{in}$ is less than $V_{ref}$. $V_{in}$ is preferably derived from the outputs signal at 48 through a voltage divider that includes R7 and R8.

The compensation capacitor $C_c$ is coupled from the output at 48 to a node 60 at the base of transistor Q7, and serves a function as described above.

Having described preferred embodiments of the present invention, it should be apparent that other modifications can be made without departing from the scope of the invention as defined by the appended claims. The terms and expressions which are used herein are used as terms of expression and not of limitation. There is no intention in the use of such terms and expressions of excluding the equivalents of the features shown and described, or portions thereof, it being recognized that various modifications are possible in the scope of the present invention.

What is claimed is:

1. A regulator for providing a regulated output signal at an output terminal, the regulator comprising:

an input stage for receiving an input voltage signal and a reference voltage signal and providing an input stage output signal, the input stage output signal being based on a difference between the input voltage signal and the reference voltage signal, the input voltage signal being derived from the regulated output signal at the output terminal;

an inverting stage coupled to the input stage for inverting the input stage output signal and providing an inverter output signal;

an output stage, responsive to the inverter output signal, for providing the regulated output signal; and a capacitor coupled between the input stage output and the regulated output signal.

2. The regulator of claim 1, wherein the inverting stage has unity gain.

3. The regulator of claim 1, wherein the input stage includes a differential transistor pair and a buffer.

4. The regulator of claim 1, wherein the output stage includes an N-type transistor for receiving the inverter output signal at a control terminal, and a P-type transistor having a control terminal coupled to one side of the N-type transistor, and another terminal for providing the regulated output signal.

5. The regulator of claim 1, wherein the regulator includes a voltage divider between the regulated output signal and the input stage, the input signal being derived from the regulated output signal through the voltage divider.

6. The regulator of claim 1, wherein the inverting stage includes a transistor with a control input, a first resistor connected between the control input and the input stage output, and a second resistor connected between the control input and an input to the output stage.

7. The regulator of claim 6, wherein the first and second resistors having equal resistance.

8. The regulator of claim 1, wherein the inverting stage includes a load sensitive current source and a buffer for buffering the inverter output signal, the load sensitive current source connected to the buffer.

9. The regulator of claim 8, wherein the inverting stage includes a first transistor that inverts the input stage output signal, and the load sensitive current source includes a second transistor, wherein the control of the first and second transistors is coupled together to receive the input stage output signal through a first resistor.

10. The regulator of claim 9, wherein the buffer includes a Darlington follower transistor pair having a control coupled to the first transistor and an output coupled to the second transistor.

11. The regulator of claim 9, further including a second resistor coupled between the control of the first and second transistors and the output of the buffer.

12. A low drop-out voltage regulator for providing a regulated output signal at an output, the regulator comprising;

means for deriving an input signal from the regulated output voltage;

means for comparing the input voltage and a reference voltage and for providing an error signal based on a difference between the input voltage and the reference voltage at an input stage output;

means for inverting the error signal;

means for receiving the inverted signal and providing the regulated output signal; and a capacitor coupled to the input stage output and to the regulated output signal for compensating the regulator.

13. The regulator of claim 12, wherein the inverting means inverts with unity gain.

14. The regulator of claim 12, wherein the inverting means includes a transistor with a control input for receiving the error signal.

15. The regulator of claim 12, wherein the deriving means includes a voltage divider.

16. The regulator of claim 12, wherein the inverting means includes a load sensitive current source and a buffer for buffering the error signal, the load sensitive current source connected to the buffer.

17. The regulator of claim 16, wherein the inverting means includes a first transistor that inverts the error signal, and the load sensitive current source includes a second transistor, wherein the control of the first and second transistors is coupled together to receive the error signal through a first resistor.

18. The regulator of claim 17, wherein the buffer includes a Darlington follower transistor pair having a control connected to the first transistor and an output connected to the second transistor.

19. The regulator of claim 16, further including a second resistor coupled between the control of the first and second transistors and the output of the buffer.

20. A regulator for providing a regulated output signal at an output terminal, the regulator comprising:

a transconductance stage that receives an input voltage signal and a reference voltage signal and provides an amplified error signal based on a difference between the input voltage signal and the reference voltage signal at a transconductance stage output lead, the input voltage signal being derived from the regulated output signal at the output terminal;

an inverting stage that receives the amplified error signal from the transconductance stage and inverts the amplified error signal to provide an inverted amplified error signal;

a first transistor having a control lead that receives the inverted amplified error signal and providing a drive signal;

a second transistor having a control lead that receives the drive signal and coupled to the output terminal to provide the regulated output signal; and a capacitor coupled between the output terminal and the transconductance stage output lead.

21. The regulator of claim 20, wherein the first and second transistors are bipolar transistors.

22. The regulator of claim 21, wherein the first transistor is an NPN transistor which has a base that receives the inverted amplified error signal, and a collector that provides the drive signal; and wherein the second transistor is a PNP transistor that has a base that receives the drive signal and a collector that provides the regulated output signal.

23. The regulator of claim 20, further comprising a buffer having an input lead coupled to the capacitor and to the transconductance stage output lead, and an output lead coupled to the inverting stage.

24. The regulator of claim 23, wherein the buffer includes a PNP transistor and an NPN transistor.

25. The regulator of claim 20, further comprising a load sensitive current source coupled to receive the signal provided to the inverting stage and connected on one side to the control lead of the first transistor.

* * * * *